United States Patent [19]

Wetter

[11] Patent Number: 4,886,265

[45] Date of Patent: Dec. 12, 1989

[54] APPARATUS AND METHOD FOR STACKING PRINTED PRODUCTS, ESPECIALLY PRINTED PRODUCTS ARRIVING IN AN IMBRICATED FORMATION

[75] Inventor: Jakob Wetter, Wetzikon, Switzerland

[73] Assignee: Ferag AG, Hinwil, Switzerland

[21] Appl. No.: 249,576

[22] Filed: Sep. 26, 1988

[30] Foreign Application Priority Data

Oct. 2, 1987 [CH] Switzerland ..... 3853/87

[51] Int. Cl.[4] ..... B65H 29/14

[52] U.S. Cl. ..... 271/279; 271/200; 271/216; 414/788.3; 414/791.2; 414/794.5; 414/907

[58] Field of Search ..... 271/279, 200, 210, 215, 271/216, 217; 414/791.2, 788.3, 907, 794.5

[56] References Cited

U.S. PATENT DOCUMENTS

| | | | |
|---|---|---|---|
| 4,541,763 | 9/1985 | Chandhoke | 414/907 X |
| 4,547,112 | 10/1985 | Steinhart | 414/907 X |
| 4,720,229 | 1/1988 | Steinhart | 414/788.3 X |

FOREIGN PATENT DOCUMENTS

| | | |
|---|---|---|
| 1436495 | 1/1969 | Fed. Rep. of Germany . |
| 2272935 | 12/1975 | France . |
| 1568752 | 6/1980 | United Kingdom . |

*Primary Examiner*—Richard A. Schacher

*Attorney, Agent, or Firm*—Bell, Seltzer, Park & Gibson

[57] ABSTRACT

Printed products are infed in an imbricated formation by a transport device to a stacker apparatus. These printed products are transported by a delivery belt conveyor and an infeed belt conveyor to a pivotably mounted infeed device. The outfeed end region of the infeed device opens into a stacker chute of a stacker device. At the infeed device there is arranged a support element. The printed products delivered by the infeed device to the stacker chute slide onto an elevationally displaceable stacker table. This infeed device is supported by the support element upon the stacked printed products. Governed by the pivotal motion of the infeed device, the stacker table of the stacker chute is incrementally lowered. As soon as sufficient printed products are available for forming a first partial stack in the stacker chute, this first partial stack is pressed by presser structure comprising piston-and-cylinder units and then this first partial stack is rotated about an upright axis through about 180° in conjunction with the stacker chute. Now a second partial stack, turned through about 180° with respect to the first partial stack, can be formed upon the first partial stack. At the stacker apparatus, there are arranged a number of such infeed devices and stacker devices, so that during product pressing and turning of a partial stack the infed printed products can be delivered to a further one of the stacker devices for product stack formation.

16 Claims, 4 Drawing Sheets

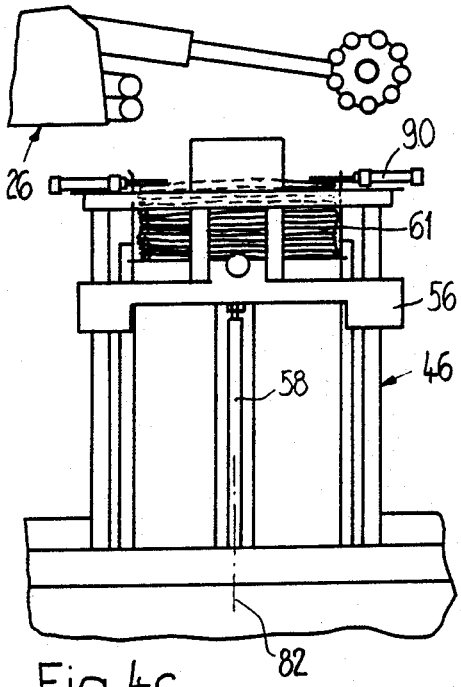
Fig.4c
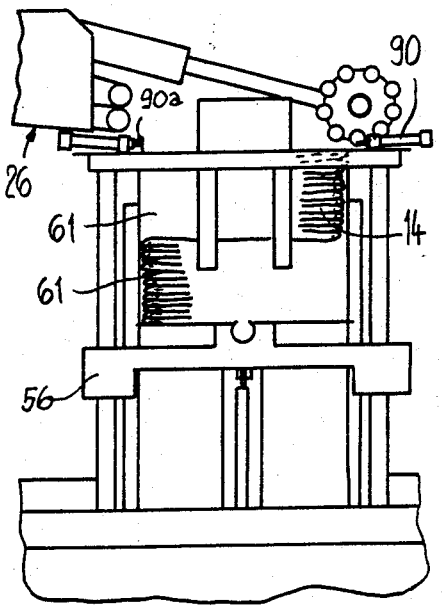
Fig.4d
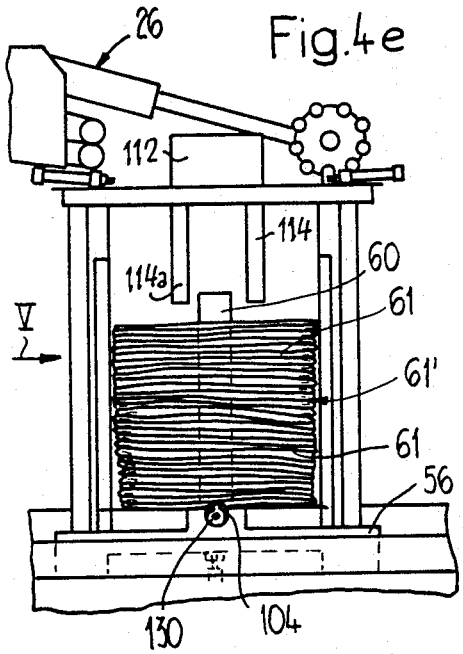
Fig.4e
Fig.5
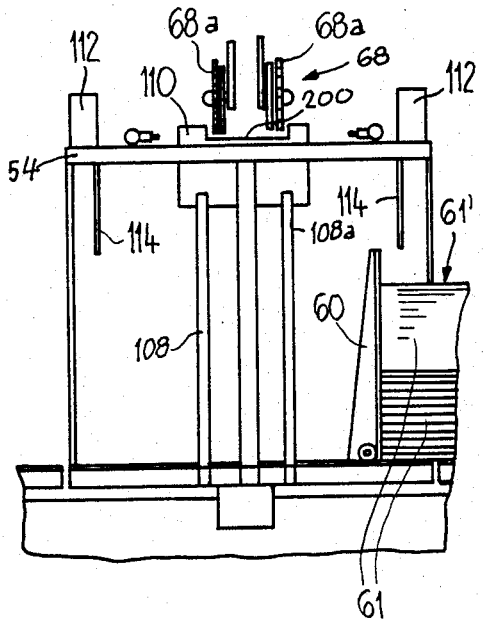

APPARATUS AND METHOD FOR STACKING PRINTED PRODUCTS, ESPECIALLY PRINTED PRODUCTS ARRIVING IN AN IMBRICATED FORMATION

BACKGROUND OF THE INVENTION

The present invention broadly relates to product stacking apparatuses and, more particularly, concerns a new and improved construction of stacking apparatus for stacking or piling printed products, especially printed products arriving in an imbricated or shingled formation. The present invention also relates to an improved method of stacking or piling such printed products.

Generally speaking, the stacking or stacker apparatus for stacking or piling printed products, especially printed products arriving in an imbricated or shingled formation, such as newspapers, periodicals, magazines and the like, is of the type comprising at least one stack former, in particular at least one stacker or stack chute provided with an elevationally displaceable stacker or stack table. There is also provided at least one infeed device arranged upstream or ahead of the stacker chute as viewed with respect to a predetermined direction of travel or infeed of the printed products. This infeed device is pivotable about a pivot axis or shaft arranged at a starting or inlet or infeed region of such infeed device. In an operating position of this infeed device, the latter bears at the region of an end of such infeed device, particularly the product outfeed or outlet end region opening directly into the stacker chute upon the product stack which is to be formed.

Such type of stacking or stacker apparatus is known in this technology from German Published Patent No. 1,436,495, published Jan. 23, 1969. Such prior art stacking apparatus comprises a stacker chute containing an elevationally displaceable stacker table. The product infeed device is arranged upstream of the stacker table. Such product infeed device is mounted to be pivotable about a pivot axis arranged at the starting region of the product infeed device. When the product infeed device assumes its operating or working position, the end region of such product infeed device and which opens into the stacker chute bears upon the product stack which is to be formed. For this purpose, the product infeed device contains an arm member which protrudes past the downstream end of the product infeed device and at which there is arranged a rotatably driven wheel or roll serving to support the product infeed device and at the same time to convey the infed printed products against a stop or impact member. During the stack formation the stacker table is located in its upper terminal position and the product infeed device accommodates itself to the momentarily or currently prevailing stack height by pivoting about its pivot axis. As soon as sufficient printed products have been stacked, then the further infeed of the printed products is interrupted and the product infeed device, while in its upper terminal position, is pivoted or rocked. The stacker table is lowered and the product stack is deposited upon a belt conveyor which outfeeds the product stack in the same direction as the products were infed. Then the stacker table is again raised and the product infeed device is lowered in order to form a new product stack. As a general rule, such product stacks possess a relatively poor stack stability, particularly when the product stack is formed of folded printed products. This is so, because the printed products at the region of the product fold, possess a greater thickness than at the marginal or edge region which is situated opposite the product fold. Thus, the permissible product stack height is appreciably limited.

A stacking or stacker apparatus equipped with two stacker chutes has been disclosed, for instance, in the German Published Patent Application No. 2,752,513, published Apr. 26, 1979 and the cognate British Patent No. 1,568,752, published June 4, 1980. With such prior art stacking apparatus, each stacker chute has arranged upstream thereof a partial stack formation device and such again has associated therewith a product infeed device which is fixedly arranged in a frame. The stacker chutes are separated by slides from the associated partial stack formation devices. The printed products infed in an imbricated product stream or formation arrive by means of a further conveyor arranged upstream of the product infeed device at such product infeed device and are transported by such product infeed device to the partial stack formation device.

The printed products, while being confined by boundary ledges, fall within the confines of the boundary ledges upon the slides or else upon printed products which have already been deposited upon such slides. As soon as a sufficient number of product copies of the printed products are available at a partial stack then by opening the slides the formed partial stack falls onto an elevationally displaceable stacker table or upon a further partial stack already located upon such stacker table. On the other hand, the printed products of the incoming imbricated stream or formation are delivered to the partial stack forming device which is operatively associated with the second stacker chute. After lowering of the stacker table, the slides are placed in their closed position so that the partial stack formation device is ready to receive further printed products. To ensure for a crosswise stacking of the partial stacks, the stacker table together with the partial stack reposing thereupon, is rotated through an angle of about 180° about a vertical axis and, if desired, raised against the slides in order to press or compact the partial stack and thereafter again slightly lowered. In this way, a partial stack is alternately formed in each of both partial stack formation devices and the partial stacks in the associated stacker chute are each deposited in a crosswise posture or configuration upon the related stacker table. As soon as the partial stack within a stacker chute has attained a desired total product stack height, then the stacker table is completely lowered and the product package formed of crosswise superimposed partial stacks is ejected by an ejector device or ejector as the same has been disclosed, for instance, in Swiss Patent No. 623,287 and the corresponding U.S. Pat. No. 4,229,134, granted Oct. 21, 1980.

SUMMARY OF THE INVENTION

Therefore with the foregoing in mind it is a primary object of the present invention to provide a new and improved construction of a product stacking or stacker apparatus, improving upon the heretofore discussed prior art constructions, such that there can be formed at relatively great processing speeds, product stacks of exceptionally good stack quality.

Another and more specific object of the present invention aims at the provision of a new and improved construction of stacking apparatus for printed products, especially printed products arriving in an imbricated formation or stream, wherein multiple products stacks, each possessing good stack stability can be formed at relatively high production rates.

Yet a further notable object of the present invention is directed to a new and improved construction of a product stacking or stacker apparatus which is relatively simple in construction and design, not readily subject to breakdown or malfunction, requires a minimum of maintenance and servicing, and allows the formation of quite stable product stacks at relatively high processing speeds.

Now in order to implement these and still further objects of the invention, which will become more readily apparent as the description proceeds, the stacking or stacker apparatus of the present development, among other things, is manifested by the features that the stacker chute is provided at its upper region with retention or holder elements which can be extended or thrust into the stacker chute and again retracted or thrust out therefrom. When the product infeed device is in its rest or ineffectual position, then the stacker chute together with the retention or holder elements can be periodically rotated or turned about an upright axis, preferably an essentially vertical or vertically extending axis, and desirably in each case through an angle of approximately 180°.

As noted, the retention or holder elements are provided at the upper region of the associated stacker chute and can be extended into and retracted out of such stacker chute. When the retention elements are in their extended position, then by raising the associated stacker table, the printed products located in such stacker chute can be pressed so as to form a compact partial stack or finished stack, as the case may be. This allows forming stacks of greater total stack height. Since the retention or holder elements can be periodically rotated or turned in conjunction with the stacker chute about an essentially vertical axis, preferably through an angle of about 180° in each case, it is possible to form product stacks wherein partial stacks thereof are turned or rotated in relation to one another, in other words the partial stacks are postured within the total product stack in crosswise configuration. Since it is possible to rotate or turn the stacker chute during such time as the retention or holder elements are in their extended or thrusted-out position, rapid rotation of the stacker chute is possible without the danger of positional shifting of the then formed product stack. In this way, it is possible to appreciably shorten the cycle time for the formation of a product stack.

Since the printed products are transported or forwarded by the product infeed device directly into the stacker chute, there can be beneficially dispensed with a partial stack formation device as such is known from the previously discussed German Patent Publication No. 2,752,513 and the cognate British Patent No. 1,568,752.

According to an advantageous construction of the product stacking or stacker apparatus of the present development there are provided a plurality of stacker chutes. Each stacker chute has arranged upstream thereof, as viewed in the product infeed direction, an associated product infeed device so that the printed products can be delivered in product sections, in other words, predeterminate sequences of the arriving printed products can be delivered to each of the plurality of stacker chutes. This advantageously allows stacking continuously arriving printed products since the printed products are alternately infed or delivered into the different stacker chutes in the aforementioned product sections or sequences.

As already alluded to previously, the invention is not only concerned with the aforementioned product stacking apparatus but also pertains to a method of stacking printed products, especially printed products arriving in an imbricated or shingled formation or stream. In order to achieve a total stack height within the stacker chute or in one of the stacker chutes if a plurality of stacker chutes of plural stacker devices are provided, the invention contemplates lowering the product infeed device into an operating or working position and infeeding a predeterminate number of printed products while lowering the stacker table of the related stacker chute as a function of the angle of pivoting of the product infeed device until there is formed a partial stack from the infed printed products. The product infeed device is then raised into a rest or ineffectual position, the formed partial stack or the superposed formed partial stacks are pressed or consolidated and rotated or turned in conjunction with the stacker chute about a substantially vertical axis through an angle of about 180°. Upon attaining a predetermined total stack height the product infeed device remains in its operating or working position, the product stack is pressed, the stacker table is lowered and the product stack is ejected. The stacker table is subsequently brought into its upper terminal position, and when there are employed a plurality of stacker chutes, then during the time when printed products are not delivered or forwarded to one stacker chute, the printed products are delivered or forwarded to another one of the stacker chutes for product stack formation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIGS. 4*a*, 4*b*, 4*c*, 4*d* and 4*e* respectively show in side view and on a smaller scale than the showing of FIG. 2, parts of the stacking apparatus depicted in FIG. 2 in different stages of the product stack formation; and FIG. 5 is a fragmentary side view of the parts of 1 the stacking apparatus depicted in FIG. 4*e*, looking in the direction of the arrow V thereof.

DETAILED DESCRIPTION OF THE PREFERRED EMBODIMENTS

Figure 1:
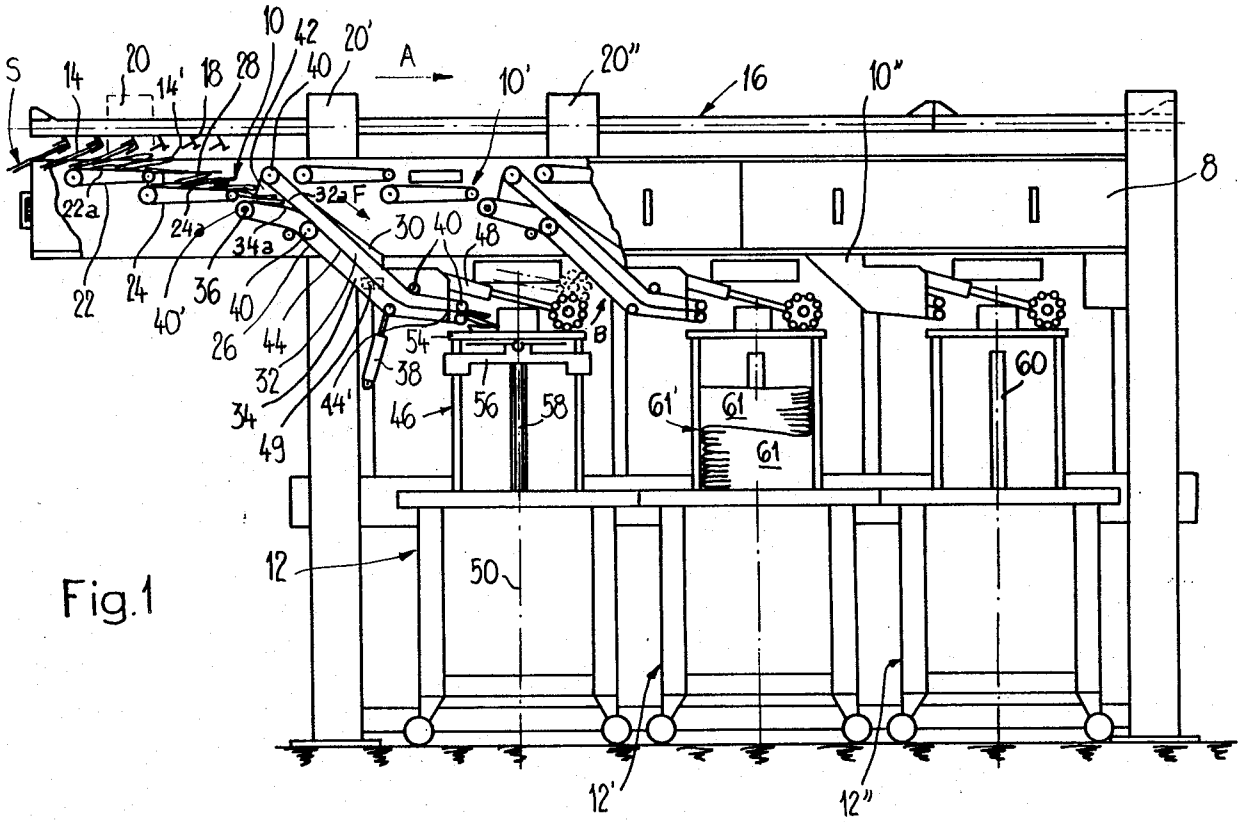
FIG. 1 illustrates in side view, partially in section, a product stacking or stacker apparatus for stacking or piling or printed products arriving continuously in an imbricated formation or stream.

Describing now the drawings, it is to be understood that to simplify the showing of the exemplary embodiment of product stacking or stacker apparatus, only enough of the construction thereof has been illustrated therein as is needed to enable one skilled in the art to readily understand the underlying principles and concepts of this invention. Turning now specifically to FIG. 1, there has been schematically depicted therein an exemplary embodiment of product stacking or stacker apparatus which stacks or piles folded printed products 14 arriving in an imbricated or shingled formation or stream, such as newspapers, periodicals, magazines or the like. The individually formed product stacks are subsequently further processed in any desired manner not pertinent to the present invention so that such need not here be further considered.

The product stacking or stacker apparatus will be seen to comprise, in the exemplary embodiment under discussion, for instance, three sequentially or tandemly arranged product infeed apparatuses or arrangements 10, 10', and 10'' arranged at support frame or structure 8 and three likewise successively or tandemly arranged stacking devices 12, 12' and 12''. Since such product infeed apparatuses or arrangements and stacking devices are identically constructed it will suffice to describe one such product infeed apparatus and one such product stacking device.

The printed products 14 are delivered or infed by a transport device 16. This transport device 16 is provided at a not particularly illustrated but a conventional traction element with controlled grippers or gripper elements 18—also referred to in the art as product clamps—which are fastened in spaced relationship from one another at such traction element, each such gripper or gripper element 18 retaining a related printed product 14. These grippers or gripper elements 18 may be constructed, for instance, in the manner of the grippers or gripper elements disclosed in Swiss Patent No. 592,562 and the cognate U.S. Pat. No. 3,955,667, granted May 11, 1976, the disclosure of which is thus incorporated herein by reference. It is therefore unnecessary to consider further details of these grippers or gripper elements 18. In any event, these grippers or gripper elements 18 are moved in the direction of the arrow A and when actuated, as is known in this technology by an associated gripper release or control device 20, 20' or 20'', release the retained printed product 14 at a desired location along the transport device 16. It is here noted that the arriving printed products 14 are infed or forwarded in an imbricated stream or formation S with their product fold 14' leading.

Each product infeed apparatus or arrangement, such as the product infeed apparatus or arrangement 10 comprises a delivery or deposit belt conveyor 22 or equivalent structure, an infeed belt conveyor 24 or equivalent structure arranged downstream of the delivery belt conveyor 22 and an infeed device 26. The infeed belt conveyor 24 is operatively associated with any suitable and thus only here schematically depicted product squaring or alignment device 28 which squares or aligns up the side edges of the printed products 14 with respect to one another. Two belt or band conveyors 32 and 34 or equivalent structure are arranged at a rocker or balance member 30 of the product infeed device 26. This rocker or balance member 30 is pivotably mounted at a pivot shaft or shaft member 36 defining a pivot axis and which is located at the starting or product inlet or infeed region of the product infeed device 26. By means of any suitable displacement unit, such as the depicted up-and-down lift cylinder unit 38 this rocker or balance member 30 can be placed into the full line depicted operating or work position and the chain-dot line depicted rest or ineffectual position.

The endless belt conveyors 32 and 34 are guided about rolls or rollers 40 or the like, rotatably mounted at the rocker or balance member 30. The roll or roller 40' of the belt conveyor 34 and located at the starting or infeed region of such belt conveyor 34 is arranged coaxially with respect to the pivot shaft or shaft member 36. The conveying-active run **32*a* and 34*a* of each of both belt conveyors or conveyor devices 32 and 34, respectively, form at the starting or product infeed region of the product infeed device 26 an inlet or infeed opening 42 and, viewed in the product conveying or movement direction F, thereafter such conveying-active runs 32*a* and 34*a* are guided substantially parallel to one another so that these belt conveyors 32 and 34 form a narrow conveying gap or space 44 for the printed products 14. The downstream located end 44' of the product conveyor or conveying gap 44 opens into a product stack former, here shown as a stacker or stack chute 46 of the related product stacking device 12. The product infeed device 26 is provided at its one end region, here the downstream end region or outfeed end region, with a protruding support element 48 which will be considered more fully hereinafter. At the support frame 8 there is mounted a suitable sensor or detector unit 49 which when the product infeed device 26 is pivoted out of the so-to-speak "field of view" of this sensor or detector unit 49**, detects such pivoting motion and generates a suitable control signal.

At the stacker device 12, which advantageously may constitute a mobile stacker device or unit, the associated stacker chute 46 is arranged at a frame 50 or the like. At two upright or substantially vertically extending guide rods or rod members 52, which are interconnected with one another by a frame structure 54 at the upper rod ends **52*a*, there is guided for elevational displaceable motion a stacker table 56. For this purpose, the stacker table 56 is connected with a piston rod 58 of a suitable lift or elevational drive, generally indicated by reference character 200 and which is arranged in the associated frame or frame structure 50. Reference numeral 60 designates an ejector or ejector device which, as will be explained more fully hereinafter, serves for the ejection of a product stack 61' which is formed of the partial stacks 61**.

In the illustration of FIG. 1 of the stacker device 12 the stacker table or table member 56 is elevated to the upper region or portion of the stacker chute or chute member 46, whereas for the stacker device 12' the associated stacker table or table member 56 has been completely lowered and supports thereupon two crosswise tiered or layered partial stacks 61. In the stacker device 12'' the stacker table or table member 56 is likewise lowered, and in the associated stacker chute or chute member 56 there is not located any printed products 14.

The printed products 14 which are infed in an imbricated stream or formation S by the transport device 16 are each released at the region of the gripper release or control device 20 by the associated gripper or gripper element 18 and are deposited upon the related delivery belt conveyor 22. The conveying direction of the conveying-active run **22*a* of the delivery belt conveyor 22, the conveying-active run 24*a* of the infeed belt conveyor 24 as well as the conveying or feed direction F of the product infeed device 26 are in the same sense or direction as that of the transport device 16, whose product conveying or transport direction has been indicated by the arrow A in FIG. 1. The printed products 14 arrive from the delivery belt conveyor 22 at the infeed belt conveyor 24 where the side edges of the printed products 14 are squared up in relation to one another by means of the product squaring or alignment device 28. The infeed belt conveyor 24 conveys the printed products 14 to the inlet opening 42 of the product infeed device 26. At that location the printed products arrive at the product conveying gap or space 44 and are forwarded or delivered to the stacker chute or chute member 46**.

Figure 2:
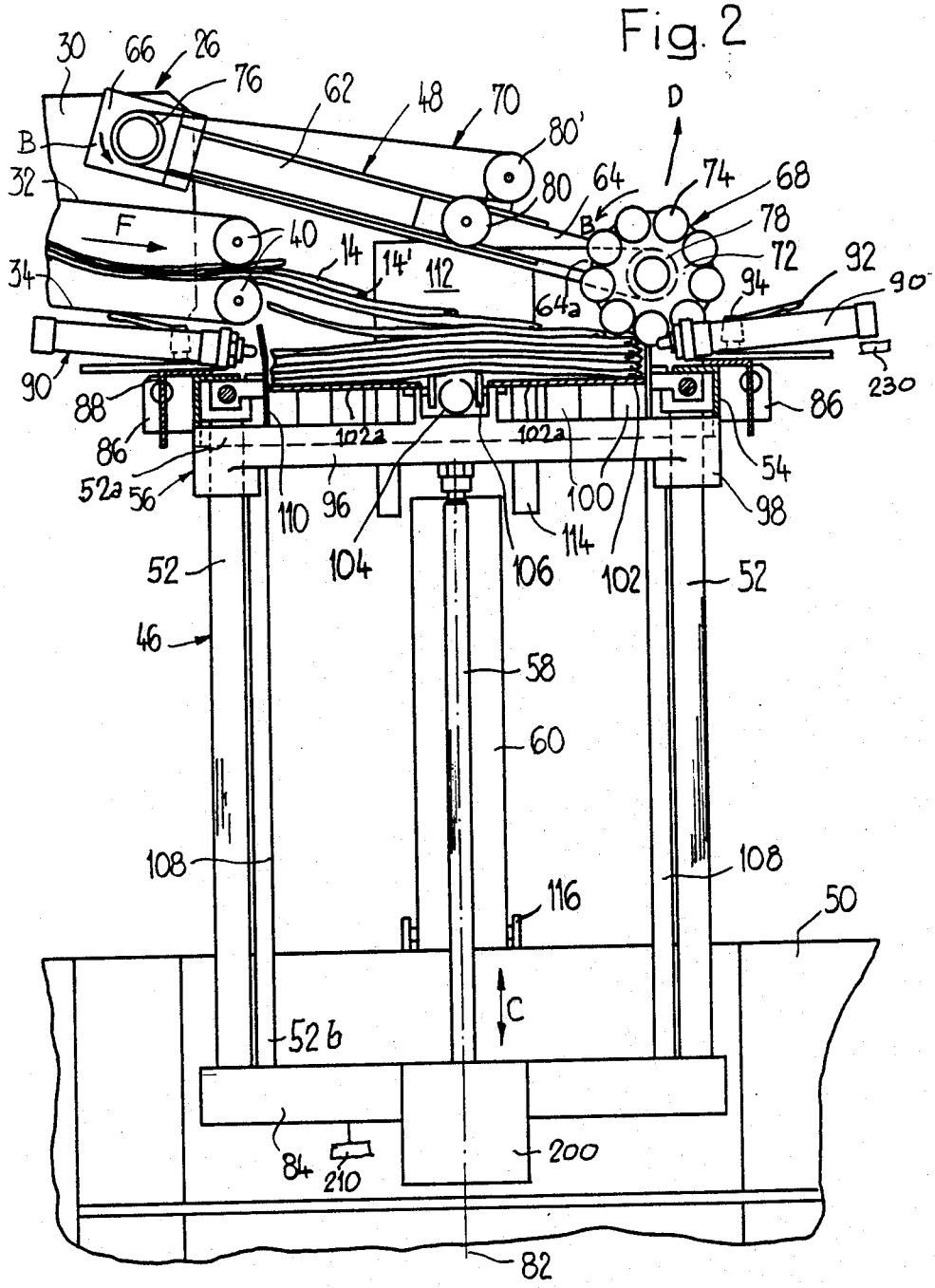
FIG. 2 illustrates in side view and on an enlarged scale in relation to the showing of FIG. 1 details of a stacker chute and the end or terminal region of the upstream arranged product infeed device.

In the illustration of FIG. 2, there has been illustrated in side and in partially sectional view the product outfeed end or end region of the product infeed device 26 provided with the support element 48 and the stacker or stacking chute or chute member 46. The rolls or rollers 40 of the belt conveyors 32 and 34 are rotatably mounted at the rocker or balance member 30. The support element 48 comprises a substantially C-shaped profile or structural member 62 in which there is telescopically displaceably guided an arm or arm member 64. This substantially C-shaped profile or structural member 62 is adjustably, but non-rotatably secured by means of a holder portion or element 66 at the rocker or balance member 30. At the free end 64*a* of the arm or arm member 64 there is rotatably mounted a stack contacting device here shown as a rotatable wheel or disc device 68. This rotatable wheel or disc device 68, for instance, can comprise a pair of mutually parallel wheel or disc members 68*a* (see FIG. 5) each containing a substantially circular disc or wheel 72 which can be driven by means of an associated belt or band 70 or equivalent drive structure, such as a chain, and at the periphery of which there are arranged freely rotatably mounted rolls or rollers 74. The drive band or belt 70 is driven by a power take-off wheel 76 of a not particularly illustrated drive unit. This drive band or belt 70 trains about a drive wheel 78 which is rigidly connected for rotation with the rotatable disc or wheel 72 and is guided in a substantially Z-shaped configuration about a respective deflection wheel 80 and 80' arranged at the arm 64 and at the substantially C-shaped profile member 62, respectively. This substantially Z-shaped guidance of the band or belt 70 renders possible telescopically displacing the arm or arm member 64 in the substantially C-shaped profile member 62 when the band or belt 70 is tensioned. The rolls or rollers 74 of the rotatable wheel or disc device 68 alternately bear upon the leading edges of the printed products 14 which are to be stacked.

The guide rods or rod members 52 bear at their lower ends 52*b* upon a base plate 84 which is rotatably mounted for rotation about a substantially vertical axis 82 in the frame or frame unit 50. The drive or drive means for rotating, for instance, the base plate 84 and thus the stacker chute 46 has been generally indicated in FIG. 2 by reference numeral 210. Such drive or drive means 210, like the elevational drive or drive menas 200, can be constituted by piston-and-cylinder units, as also disclosed in the aforementioned U.S. Pat. No. 4,229,134. The upper ends 52*a* of the guide rods or rod members 52 are connected with one another by the frame or frame structure 54, as also best seen by referring to FIG. 3. At the frame 54 there are arranged at the two oppositely situated sides which extend transverse to the conveying direction F holder noses or nose members 86 which protrude towards the outside. At these holder noses or nose members 86 there are pivotably mounted and so as to be pre-biased substantially L-shaped profiles or sectional members 88. At each substantially L-shaped profile member 88 there are displaceably mounted two product retention devices, here shown as the piston-and-cylinder units 90 which can be fixed in desired position by nut members 94 or equivalent fixation or arresting structure, each of which are provided with an associated hand grip or operating grip 92, again as seen by inspecting FIGS. 2 and 3.

At the base plate 84 there are arranged positionally adjustable impact or stop rods or rod members 108 which can be moved towards or away from one another as desired. At the upper free ends 108*a* of the impact or stop rods 108 there are secured impact or stop plates 110, for instance formed of sheet metal or metal plating, which are cut out at their upper end region as shown by the cutout or recess means 220 in FIG. 5.

As shown in FIG. 5 there are equally arranged at the frame 54 at the sides thereof which extend substantially parallel to the product conveying direction F two mutually confronting or facing vibrators or vibrator structures 112. These vibrators 112 act upon the side or lateral edges of the printed products 14 which are infed by the product infeed device 26 into the stacker chute 46. Downwardly directed vibrator tongues or tongue members 114 are arranged at these vibrators 112 and which oscillate along with the oscillations or vibrations of the vibrators 112.

The stacker table 56 comprises a support member 96 at whose end regions there are formed guide elements or guides 98 which slide along the guide rods 52. The support or carrier member 96 is provided with supports 100 at which there is secured a stacker or stacking plate or plate member 102. This stacker plate 102 comprises two partial plates 102*a* between which there are arranged a chain channel 104 and ejector or ejector rolls 106 which are rotatably mounted at the support or carrier member 96. This support or carrier member 96 is connected with the piston rod 58 which can be elevationally displaced, namely upwardly and downwardly in the direction of the double-headed arrow C of FIG. 2 by the elevational drive 200 which is arranged in the frame 50.

The ejector or ejector device 60 bears by means of further rolls or rollers 116 at the frame 50 and is displaceable at the region of the chain channel or channel member 104 by means of a conventional and thus here not particularly shown chain, in the manner for instance as disclosed in the aforementioned Swiss Patent No. 623,287, and the cognate U.S. Pat. No. 4,229,134 when the stacker table 56 has been lowered.

Figure 3:
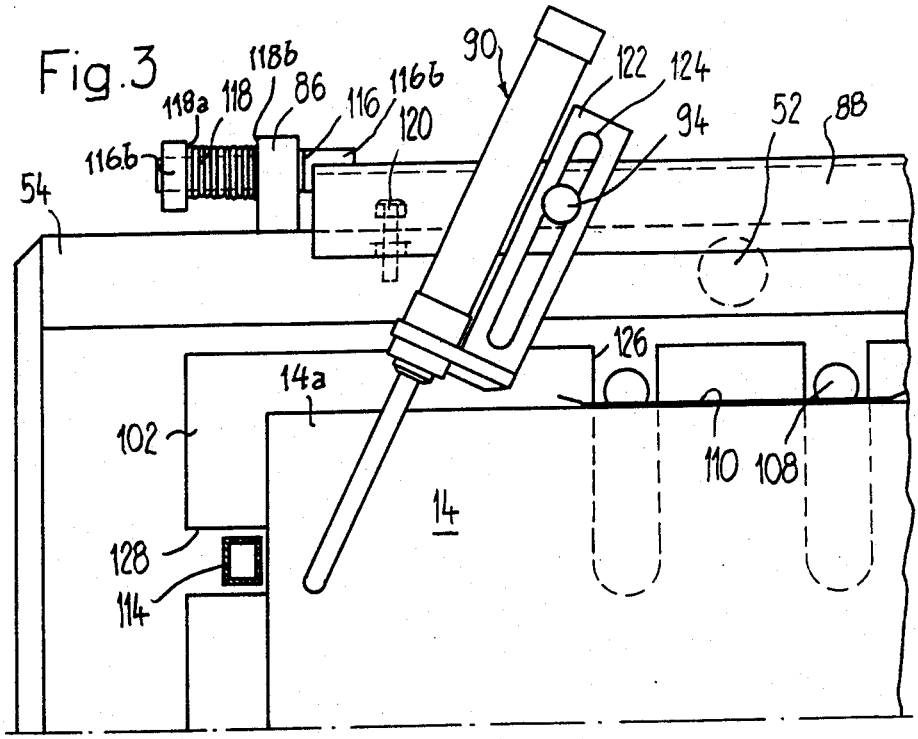
FIG. 3 is a top plan view depicting a portion of the stacker chute shown on an enlarged scale in FIG. 2.

Continuing, in FIG. 3 there has been illustrated in top plan view and on an enlarged scale a portion of the stacker chute or chute member 46. The frame 54 bears upon the guide rods 52. As previously explained, at the guide rods 52 there are arranged in pairs the holder noses or nose members 86, wherein only one such holder nose 86 has been shown in FIG. 3. A pivot bolt or bolt member 116 is mounted at the holder nose or nose member 86. At one end 116*a* of the pivot bolt 116 there is arranged the substantially L-shaped profile member 88 and the other end 116*b* of this pivot bolt 116 is connected with one end 118*a* of a helical or torsion spring or resilient element 118, the other end 118*b* of which is fixed to the holder nose 86. At the substantially L-shaped profile member 88 there is arranged an adjustable stop or impact member 120 which, by virtue of the pre-bias of the helical spring 118, bears in the rest position at the frame 54 and determines the rest position of the substantially L-shaped profile member 88. By means of the nut member 94, whose hand grip or operating grip 92 has not been depicted in FIG. 3, there is displaceably arranged a slide plate 122 having an elongate or extended hole or slot 124 and which thus can be clampingly fixed in desired position by tightening the nut member 94. At the slide plate 122 there is secured the associated piston-and-cylinder unit 90 so as to extend approximately parallel to the elongate hole or slot 124 as shown in FIG. 3.

Recesses or slots 126 provided in the stacker plate or plate member 102 are pierced by the impact or stop rods 108, at the upper ends 108*a* of which there is attached the related impact or stop plate 110. At the stacker plate 102 there are provided further recesses or slots 128 which leave space free for the downwardly depending or extending vibrator tongues 114.

In FIGS. 4*a* to 4*e* there has been depicted the same sectional view of the product infeed device 26 and the stacker device 12 as shown in FIG. 2, but depicted on a smaller scale and in simplified fashion. The reference characters employed in FIGS. 4*a* to 4*e* correspond to those used for the same parts or components described previously when discussing FIG. 2. Hence, when describing FIGS. 4*a* to 4*e* hereinafter reference only will be made again to the previously described parts or components as needed for understanding the structure shown in such FIGS. 4*a* to 4*e*.

Figure 4A:
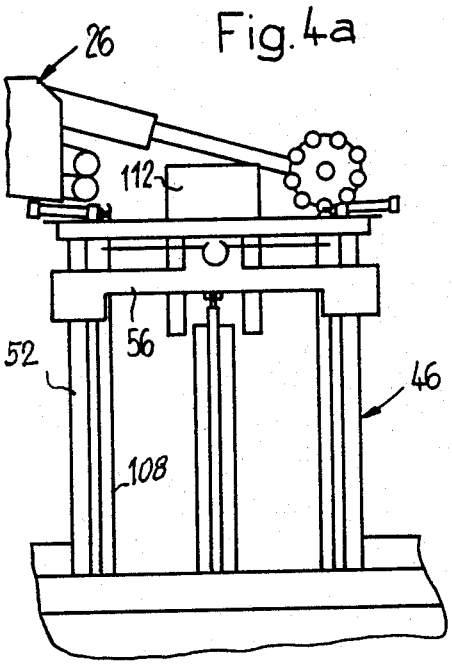

Turning first to FIG. 4*a* there will be seen the stacker table 56 in its upper end or terminal position. The product infeed device 26 is lowered into its operating or working position by appropriately actuating the up-and-down lift or displacement cylinder unit 38 (see FIG. 1). This corresponds to the starting position when there is initiated the formation of a product stack or when, as will be explained further hereinafter, a product stack or stack 61' has been displaced out of the stacker chute 46.

Figure 4B:
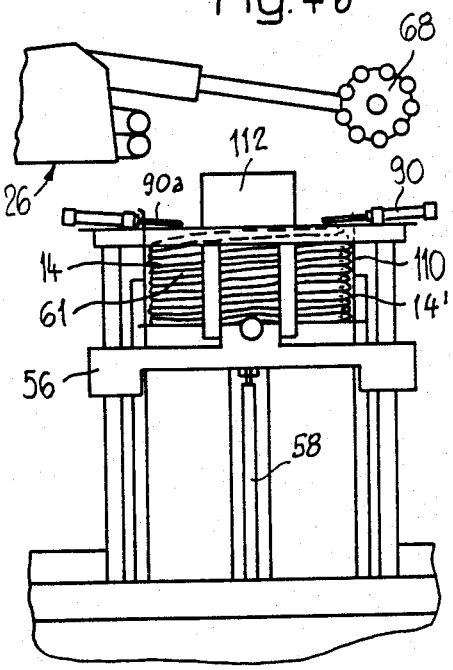

FIG. 4*b* illustrates the stacker table 56 partially lowered. Upon this stacker table 56 there is shown reposing a partial stack 61, the fold edges or folds 14' of which have been placed by means of the rotatable wheel or disc device 68 against the right-hand depicted sheet metal impact or stop member 110. The product infeed device 26 is upwardly pivoted by the lift or displacement cylinder unit 38 out of its operating or working position into its rest or ineffectual position, as shown. The piston rods 90*a* of the piston-and-cylinder units 90 are shown extended or thrusted-out at the regions of the corners 14*a* of the printed products 14 (cf. also FIG. 3).

In the showing of FIG. 4*c* the product infeed device 26 is depicted in its raised rest or ineffectual position, however the stacker table 56 has been slightly raised by means of the piston rod 58 so that the piston-and-cylinder units 90 together with the substantially L-shaped profiles 88 are pivoted or rocked against the force of the helical springs 118 into an essentially horizontal position. The partial stack 61 is pressed or compacted.

FIG. 4*d* illustrates the product infeed device 26 in its operating or working position. A further partial stack 61 formed of the printed products 14 is shown reposing in crosswise or essentially 180° turned orientation upon the first partial stack 61. The piston rods 90*a* of the piston-and-cylinder units 90 are shown retracted or withdrawn out of the region of the partial stacks 61.

In FIG. 4*e* the product infeed device 26 has likewise been shown in its operating or work position. The stacker table 56 has been completely lowered. The finished product stack 61', composed of the crosswise superimposed partial stacks 61 is shown bearing upon the stacker table 56. The chain or chain member 130 which actuates the ejector device 60 has been introduced into the chain channel 104 of the stacker table 56 and ejects the finished or completed product stack 61'. This finished product stack 61' has also been shown in FIG. 5 in a side view of the arrangement of FIG. 4*e* as would be seen when generally looking in the direction of the arrow V thereof. The ejector or ejector device 60 moves between and past the vibrator tongues 114 of the vibrator devices or vibrators 112. On the other hand, the finished product stack 61' is of a lesser height than the lowermost extent of the vibrator tongues 114 so that the finished product stack 61' can be shoved out beneath the lower ends 114*a* of the vibrator tongues 114. There is particularly visible in the illustration of FIG. 5 the upper cutout or recess means 220 at the depicted sheet metal impact or stop member 110. In such upper recess means or channel 220 there can rotate both of the generally parallely arranged wheel or disc members 68*a* of the associated product infeed device 26 without such wheel or disc members 68*a* touching one another.

Having now had the benefit of the foregoing description of the product stacking or stacker apparatus, there will be described hereinafter the operation thereof for the stacking or piling of printed products 14 which continuously arrive in an imbricated or shingled stream or formation S and by virtue of such description there will also be described a preferred method for the operation of such product stacking apparatus.

A first arriving product section or sequence of printed products 14 of the imbricated stream or formation S is delivered to a first product infeed apparatus, for instance the product infeed apparatus 10, by opening the grippers or gripper elements 18 with the aid of the associated gripper release device 20. The associated product infeed device 26 is lowered into its operating or working position, as the same has been depicted in FIGS. 2 and 4*a*. The stacker or product receiving table 56 is located in its upper end or terminal position. The printed products 14 which are infed by the product infeed device 26 to the stacker chute 46 drop onto the stacker plate or stacker plate unit 102 and are forced by the rolls or rollers 74 of the rotatable wheel or disc 68, which is driven to rotate in the direction of the arrow B, towards the neighboring impact plate 110. This rotatable wheel or disc device 68 bears upon the superposed stacked printed products 14, so that the rocker or balance member 30 is pivoted or rocked in the counterclockwise direction as indicated by the arrow D in FIG. 2.

As soon as the rocker or balance member 30 has triggered the aforedescribed control signal at the sensor or detector unit 49, then the stacker table 56 is incrementally lowered to such an extent until the product infeed device 26 is again located at its starting or initial position. This operation repeats until sufficient product copies of the printed products 14 are located in the stacker chute 46 for forming a partial stack 61. The vibrators 112, during the stacking operation, act upon the side or lateral edges of the printed products 14 so that they are stacked in a squared-up or aligned condition. As soon as a partial stack 61 has been formed then the next section or sequence of arriving printed products 14 of the imbricated stream or formation S is forwarded to a further product infeed device, for instance the next following product infeed device 10' and thus arrives at the further stacker device 12' where a further partial stack 61 is formed in the previously described manner.

The product infeed device 26 of the first infeed apparatus or arrangement 10 is upwardly pivoted into the rest or ineffectual position (cf. FIG. 4*b*) and the stacker table 56 is lowered together with the first partial stack 61 reposing thereupon to such an extent that the piston rods 90*a* of the piston-and-cylinder units 90 can be extended or thrusted-out (see also FIG. 3). Now the first partial stack 61 is pressed or compacted in that the stacker table 56 is upwardly displaced or shifted until, owing to the exerted compression force or pressure, the piston-and-cylinder units 90 are each rocked against the force of the helical springs 118 into an approximately horizontal position.

Due to the pre-bias of the helical springs 118 it is thus possible to preselect the pressing or compressing force which is applied to the partial stack 61. A schematically depicted position sensor or detector 230, as shown at the right-hand side of FIG. 2 for one of the piston-and-cylinder units 90, detects the generally horizontal position of the associated piston-and-cylinder unit 90 and causes shut-down of the elevational or raising motion of the stacker table 56. Now the stacker chute 46 in conjunction with the therein pressed or compressed partial stack 61 is rotated or turned through an angle of about 180° around the substantially upright or vertical axis 82. Thereafter, there is accomplished a slight lowering or dropping of the stacker table 56 until the piston-and-cylinder units 90 are relieved of load, so that the associated piston rods 90*a* thereof can be retracted out of the stacker chute 46. Thereafter, the product infeed device 26 is again downwardly rocked into its operating or work position, as shown in FIG. 4*d* and a next product section or sequence of arriving printed products can be forwarded into this stacker or stacking device 12. This occurs as soon as in one of the other stacker or stacking devices 12' or 12'' there has been formed a full partial stack 61. As soon as the second partial stack 61 has been formed upon the first partial stack 61 and in an offset posture turned through an angle of about 180° there occurs a conjoint pressing or compression of both of these two formed partial stacks 61 and rotation through 180°, as such has been previously described above in conjunction with the single partial stack 61.

This operation repeats until a predetermined number of partial stacks 61 are located within the stacker chute 46. As soon as the last printed product 14 has been infed to the uppermost partial stack 61 of the stacker chute 46, the product infeed device 26 remains in its operating or working position, but the entire or complete product stack 61' can be pressed one more time in the manner described above. Thereafter, the stacker table 56 is completely lowered, as shown for instance in FIGS. 4*e* and 5, so that thereafter the entire or complete product stack 61' can be ejected by the ejector or ejector device 60 out of the stacker chute 46 in order to be able to subsequently appropriately further process the ejected complete product stack 61'. After renewed upward elevation of the stacker table 56 the stacker or stacking device 12 is now ready for the formation of a further partial stack 61.

As already previously described, as soon as a sufficient number of printed products have been stacked to form a partial stack 61, then a subsequent product section or successive number of printed products 14 of the imbricated stream or formation S are delivered to a further one of the stacker or stacking devices 12 or 12''.

In the event that the time needed for the formation of a partial stack 61 is greater than the time needed for the pressing or compaction of a single one or a plurality of superposed partial stacks 61 and the stack rotation through 180° as well as the possibly undertaken ejection of a complete or entire product stack 61, then two product infeed apparatuses or arrangements 10 and 10' and two product stacker or stacking devices 12 and 12' will be sufficient to ensure that the transport device 16 need not be shut-down. However, if this stack pressing or compaction time is greater than the time which is required for the formation of a partial stack 61, then three or more product infeed apparatuses, such as the product infeed apparatuses or arrangements 10, 10' and 10'' and three or more product stacker or stacking devices such as the stacker devices 12, 12' and 12'' can be provided in the stacking or stacker apparatus, so that partial stacks 61 can be formed in each of these stacker devices in alternating or sequential fashion and there is available sufficient time at the remaining product stacking devices 12, 12', 12'' and so forth for the pressing, rotating and possibly undertaken ejection of the complete product stack 61' without having to interrupt the infeed of the imbricated stream or formation S of printed products 14.

It is to be observed that the mobile stacker or stacking devices 12, 12', 12'' and so forth, for instance during resetting or set-up operations when converting the equipment to handle a different format of the printed products 14, can be moved out of the region of the support frame 8, facilitating accessibility of the operating personnel to the product infeed apparatuses or arrangements 10, 10', 10'' and so forth as well as the product stacker or stacking devices 12, 12', 12'' and so forth.

The stacking apparatus or installation described previously has been shown to possess three respective tandemly arranged product infeed apparatuses or arrangements 10, 10' and 10'' arranged at a support frame 8 and three successively or sequentially arranged stacker or stacking devices 12, 12' and 12''. However, a stacker apparatus construction is also conceivable which embodies only a single product infeed apparatus, such as the product infeed apparatus 10 and a single product stacker or stacking device, such as the product stacker or stacking device 12. In any event, it is then necessary during rotation of the stacker chute and ejection of the formed product stack to interrupt the further infeed of printed products or the like.

While there are shown and described present preferred embodiments of the invention, it is to be distinctly understood that the invention is not limited thereto, but may be otherwise variously embodied and practiced within the scope of the following claims.

Accordingly, what is claimed is:

1. A stacking apparatus for stacking printed products, such as newspapers, magazines, periodicals and the like, arriving in an imbricated stream, comprising:

at least one stacker chute;

an elevationally displaceable stacker table provided for said stacker chute;

means for elevationally displacing said stacker table;

at least one product infeed device arranged upstream of said stacker chute with respect to a predetermined direction of movement of the printed products;

said product infeed device having a product infeed end region and a product outfeed end region;

means for pivotably mounting said product infeed device about a pivot axis arranged at the product infeed end region of the product infeed device;

said product infeed device being pivotably movable between a rest position and an operating position;

said product infeed device, when in said operating position thereof, having said outfeed end region directly opening into the stacker chute and being supportable upon a product stack which is to be formed within said stacker chute;

said stacker chute having an upper region;

product retention means provided at said upper region of said stacker chute;

said product retention means being extendable into and retractable out of said stacker chute;

means mounting said stacker chute to be rotatable about a substantially vertical axis through a predetermined angle of rotation; and means for periodically rotating said stacker chute together with said product retention means about said substantially vertical axis through said predetermined angle when said product infeed device is located in said rest position.

2. The stacking apparatus as defined in claim 1, wherein:

said means for periodically rotating said stacker chute together with said product retention means through said predetermined angle rotates said stacker chute together with said product retention means through an angle of approximately 180°.

3. The stacking apparatus as defined in claim 1, further including:

means for incrementally lowering said stacker table as a function of a predetermined pivot angle of said product infeed device.

4. The stacking apparatus as defined in claim 3, wherein:

said product retention means comprise piston rod means of piston-and-cylinder units.

5. The stacking apparatus as defined in claim 4, further including:

means mounting each of said piston-and-cylinder units to be pivotable about a substantially horizontal pivot axis; and means for pre-biasing each of said piston-and-cylinder units such that with the piston rod means thereof in an ejected position there is exerted a pressure force upon a product stack raised into abutting contact with the piston rod means and located upon the elevationally displaceable stacker table.

6. The stacking apparatus as defined in claim 1, further including:

said product retention means comprise piston rod means of piston-and-cylinder units.

7. The stacking apparatus as defined in claim 1, further including:

stack ejector means for ejecting a formed product stack out of the stacker chute when the elevationally displaceable stacker table is lowered; and means for introducing said stack ejector means generally at right angles with respect to a predetermined direction of product conveyance of the at least one product infeed device into the region of the elevationally displaceable stacker table.

8. The stacking apparatus as defined in claim 1, wherein:

said at least one product infeed device comprises two belt conveyors;

each of said two belt conveyors having a conveying-active run; and said conveying-active runs of said two belt conveyors delimiting a conveying gap for the printed products.

9. The stacking apparatus as defined in claim 2, wherein:

said at least one product infeed device comprises two belt conveyors;

each of said two belt conveyors having a conveying-active run; and said conveying-active runs of said two belt conveyors delimiting a conveying gap for the printed products.

10. The stacking apparatus as defined in claim 1, further including:

a plurality of said elevationally displaceable stacker chutes for stacking printed products continuously arriving in an imbricated stream;

said at least one product infeed device comprising a plurality of product infeed devices; and a respective one of each of said plurality product infeed devices being arranged upstream of a related one of each of said plurality of elevationally displaceable stacker chutes in order to infeed the printed products in sections to individual ones of said plurality of stacker chutes.

11. The stacking apparatus as defined in claim 10, wherein:

each elevationally displaceable stacker chute is structured to be movable out of the region of an associated product infeed device.

12. The stacking apparatus as defined in claim 11, wherein:

each elevationally displaceable stacker chute is structured to define a mobile stacker chute.

13. A stacking apparatus for stacking delivered products, comprising:

at least one stacker chute;

an elevationally displaceable stacker table provided for said stacker chute;

means for elevationally displacing said stacker table;

at least one product infeed device arranged upstream of said stacker chute with respect to a predetermined direction of movement of the products;

said product infeed device having a product infeed end region and a product outfeed end region;

means for displaceably mounting said product infeed device;

said product infeed device being movable between a rest position and an operating position;

said product infeed device, when in said operating position thereof, having said outfeed end region opening into the stacker chute and being supportable upon a product stack which is to be formed within said stacker chute;

said stacker chute having an upper region;

product retention means provided at said upper region of said stacker chute;

said product retention means being extendable into and retractable out of said stacker chute;

means mounting said stacker chute to be rotatable about a generally vertical axis through a predetermined angle of rotation; and means for rotating said stacker chute together with said product retention means about said generally vertical axis through said predetermined angle.

14. A method of stacking printed products, such as newspapers, periodicals and the like, arriving in an imbricated stream, comprising the steps of:

lowering a pivotable product infeed device into an operating position;

infeeding a predetermined number of printed products from the pivotable product infeed device to a stacker table while lowering the stacker table as a function of the pivot angle of the pivotal infeed device until there is formed on the stacker table a partial stack;

raising the pivotal product infeed device into a rest position;

pressing the partial stack formed on the stacker table or a plurality of partial stacks formed on the stacker table and rotating the stacker table with each partial stack formed thereon in conjunction with a stacker chute containing the stacker table about a substantially vertical axis through an angle of about 180°;

upon reaching a predetermined total stack height of printed products retaining the pivotal product infeed device in the operating position thereof;

pressing the total stack height of stacked products;

lowering the stacker table and the total stack height of stacked products;

ejecting the stacked products; and thereafter placing the stacker table in an upper terminal position.

15. The method as defined in claim 14, further including the steps of:

providing a plurality of such stacker chutes each of which has successively infed thereto printed products; and during such time that printed products are not fed into one of the stacker chutes delivering printed products to another one of said stacker chutes for product stack formation.

16. A method of stacking arriving products, comprising the steps of:

lowering a movable product infeed device into an operating position;

infeeding a predetermined number of products from the movable product infeed device to a stacker table while lowering the stacker table until there is formed on the stacker table a partial stack;

raising the movable product infeed device into a rest position;

pressing the partial stack formed on the stacker table or a plurality of partial stacks formed on the stacker table and displacing the stacker table with each partial stack formed thereon;

upon reaching a predetermined total stack height of stacked products retaining the movable product infeed device in the operating position thereof;

pressing the total stack height of stacked products;

lowering the stacker table and the total stack height of stacked products;

ejecting the stacked products; and thereafter placing the stacker table in an upper position.

* * * * *

UNITED STATES PATENT AND TRADEMARK OFFICE

CERTIFICATE OF CORRECTION

PATENT NO. : 4,886,265

DATED : December 12, 1989

INVENTOR(S) : Wetter

It is certified that error appears in the above-identified patent and that said Letters Patent is hereby corrected as shown below:

Column 4, Line 58, delete "1".

Column 14, Line 25, after "plurality" insert--of--.

Signed and Sealed this

Twenty-third Day of July, 1991

*Attest:*

*Attesting Officer*

HARRY F. MANBECK, JR.

*Commissioner of Patents and Trademarks*